US010524316B2

(12) United States Patent
Ha et al.

(10) Patent No.: US 10,524,316 B2
(45) Date of Patent: Dec. 31, 2019

(54) LOW-FREQUENCY HEATING APPARATUS AND METHOD USING MAGNETIC FIELD

(71) Applicant: Samsung Electronics Co., Ltd., Suwon-si, Gyeonggi-do (KR)

(72) Inventors: Dohyuk Ha, Gwacheon-si (KR); Jungyub Lee, Yongin-si (KR); Jun Sig Kum, Yongin-si (KR); YoungJu Lee, Seoul (KR); Goudelev Alexander, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 519 days.

(21) Appl. No.: 15/331,112

(22) Filed: Oct. 21, 2016

(65) Prior Publication Data

US 2017/0118805 A1 Apr. 27, 2017

(30) Foreign Application Priority Data

Oct. 21, 2015 (KR) ..... 10-2015-0146995

(51) Int. Cl.

| | |
|---|---|
| ***H05B 6/06*** | (2006.01) |
| ***H05B 6/10*** | (2006.01) |
| ***H05B 6/36*** | (2006.01) |
| ***H05B 6/12*** | (2006.01) |
| ***H05B 6/44*** | (2006.01) |

(52) U.S. Cl.

CPC ..... *H05B 6/44* (2013.01); *H05B 6/129* (2013.01)

(58) Field of Classification Search

CPC ..... H05B 6/06; H05B 6/10–102; H05B 6/12; H05B 6/1245; H05B 6/1272; H05B 6/36; H05B 6/40–44

See application file for complete search history.

(56) References Cited

U.S. PATENT DOCUMENTS 2,453,529 A 11/1948 Mittelmann
4,415,789 A * 11/1983 Nobue ..... H05B 6/6435 219/709

(Continued)

FOREIGN PATENT DOCUMENTS

EP 0 464 390 A2 1/1992

OTHER PUBLICATIONS

European Search Report dated Sep. 13, 2018, issued in European Application No. 16857829.2-1204 / 3342254.

*Primary Examiner* — Michael A Laflame, Jr.
(74) *Attorney, Agent, or Firm* — Jefferson IP Law, LLP

(57) ABSTRACT

A low-frequency heating apparatus is provided. The low-frequency heating apparatus includes a signal generator configured to generate an operation frequency for inducing a current through a coil unit surrounding an internal area of a housing of the heating apparatus, a power amplifier configured to amplify power of the operation frequency to a predetermined level and transmit the amplified operation frequency to the coil unit, the coil unit configured to be energized to heat an object provided inside the housing through a magnetic field generated by the current, and at least one processor configured to monitor an impedance value of the coil unit resonating at the operation frequency and control a resonant operation of the coil unit based on the impedance value of the coil unit and an impedance value of the power amplifier.

19 Claims, 19 Drawing Sheets

(56) References Cited

U.S. PATENT DOCUMENTS

| | | | | |
|---|---|---|---|---|
| 4,795,886 | A * | 1/1989 | Carter, Jr. | G05D 23/26 219/494 |
| 6,215,112 | B1 * | 4/2001 | Kim | H05B 6/6447 219/704 |
| 6,392,210 | B1 | 5/2002 | Jewett et al. | |
| 7,829,827 | B2 | 11/2010 | Rosenbloom et al. | |
| 8,968,848 | B2 | 3/2015 | Quella et al. | |
| 9,131,543 | B2 | 9/2015 | Ben-Shmuel et al. | |
| 2006/0081624 | A1 * | 4/2006 | Takada | H01J 37/32192 219/716 |
| 2007/0215608 | A1 | 9/2007 | Yoshino et al. | |
| 2007/0235445 | A1 | 10/2007 | Wilgen et al. | |
| 2009/0295509 | A1 * | 12/2009 | Master | H01P 7/06 333/219.1 |
| 2010/0187224 | A1 | 7/2010 | Hyde et al. | |
| 2011/0290790 | A1 | 12/2011 | Sim et al. | |
| 2012/0305546 | A1 | 12/2012 | Filippa et al. | |

* cited by examiner

| | ROOM TEMPERATURE | TWO HELICAL COILS | | COMPARISON |
|---|---|---|---|---|
| | SURFACE | TOP | BOTTOM | |
| 0 MIN. | -7℃ | -7℃ | - | |
| 5 MIN. | -3℃ | 3℃ | - | DEFROST EXPECTED |
| 10 MIN. | -2.3℃ | 4℃ | 8℃ | DEFROST VERIFIED |

| TIME | 0 | 5 | 10 | 15 | 20 | 25 | 30 |
|---|---|---|---|---|---|---|---|
| TEMPERATURE | 24 | 32 | 40.3 | 48 | 54.7 | 59.7 | 64.9 |

LOW-FREQUENCY HEATING APPARATUS AND METHOD USING MAGNETIC FIELD

CROSS-REFERENCE TO RELATED APPLICATION(S)

This application claims the benefit under 35 U.S.C. § 119(a) of a Korean patent application filed on Oct. 21, 2015, in the Korean Intellectual Property Office and assigned Serial number 10-2015-0146995, the entire disclosure of which is hereby incorporated by reference.

TECHNICAL FIELD

The present disclosure relates to low-frequency heating apparatuses and methods using a magnetic field.

BACKGROUND

Various heating methods of the related art may be implemented based on frequency characteristics. For example, high-frequency heating methods (e.g., heating methods implementing a frequency of 2.4 GHz or higher) induce a high-frequency electric field to spin electric dipoles in an object to be heated. The high-frequency electric field generates intermolecular friction between molecules of the object thereby generating heat. Such high-frequency heating methods may be divided into dielectric heating and microwave heating. Dielectric heating may be used in heaters, drying wood, bonding, defrosting, killing germs, and medical fields.

Low-frequency heating methods employ indirect heating to induce a current through an object (e.g., a conductor) using electromagnetic induction by interlinking magnetic fields through the object. In order to increase heating efficiencies using a low-frequency heating method, the object may be positioned within in the interlinkage of more magnetic fields by reducing the distance between a heating coil and the object. Such low-frequency heating methods may be used for thermal processing, thermal treatment, surface treatment, welding, indirect heating, or other various purposes.

The above information is presented as background information only to assist with an understanding of the present disclosure. No determination has been made, and no assertion is made, as to whether any of the above might be applicable as prior art with regard to the present disclosure.

SUMMARY

An example defrosting apparatus adopting high-frequency heating is a microwave oven. High-frequency defrosting apparatuses may defrost an object within a relatively short time, e.g., a few minutes, but reveals a few shortcomings, such as relatively high installation costs and different defrosting results depending on the shape of the object. For example, a particular portion of the object may defrost while the rest remains frozen.

The same is true for low-frequency heating apparatuses. Although low-frequency heating apparatuses enable quick defrosting, defrosting results are also based on a shape of an object. As an example, when an object has variable thicknesses, portions of the object may be unevenly defrosted.

Therefore, a need exists for a scheme for defrosting an object in an even and cost-saving manner Aspects of the present disclosure are to address at least the above-mentioned problems and/or disadvantages and to provide at least the advantages described below. Accordingly, an aspect of the present disclosure is to provide an apparatus and method for heating an object using low-frequency magnetic fields.

In accordance with an aspect of the present disclosure, a low-frequency heating apparatus is provided. The low-frequency heating apparatus includes a signal generator configured to generate an operation frequency for inducing a current through a coil unit surrounding an internal area of a housing of the heating apparatus, a power amplifier configured to amplify power of the operation frequency to a predetermined level and transmit the amplified operation frequency to the coil unit, the coil unit configured to be energized to heat an object provided inside the housing through a magnetic field generated by the current, and at least one processor configured to monitor an impedance value of the coil unit resonating at the operation frequency and control a resonant operation of the coil unit based on the impedance value of the coil unit and an impedance value of the power amplifier.

In accordance with another aspect of the present disclosure, a method performed by a low-frequency heating apparatus is provided. The method includes generating, by a signal generator, an operation frequency for inducing a current through a coil unit surrounding an internal area of a housing of the heating apparatus, amplifying, by a power amplifier, power of the operation frequency to a predetermined level and the power amplifier transmitting the amplified operation frequency to the coil unit, energizing the coil unit to heat an object provided inside the housing through a magnetic field generated by the current, monitoring, by at least one processor, an impedance value of the coil unit resonating at the operation frequency, and controlling, by the at least one processor, a resonant operation of the coil unit based on the impedance value of the coil unit and an impedance value of the power amplifier.

According to the present disclosure, the low-frequency heating apparatus and method may evenly heat an object at a reduced cost.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

According to an embodiment of the present disclosure, an apparatus for heating an object using low-frequency magnetic fields is provided. For ease of description, an example in which the object to be heated is frozen food is described according to various embodiments of the present disclosure. However, various embodiments of the present disclosure may also be applicable to other various objects than the frozen food, such as objects or targets requiring thermal treatment, sterilization, and/or heating. Hereinafter, "object to be heated" is simply referred to as an object for ease of description.

Figure 1:
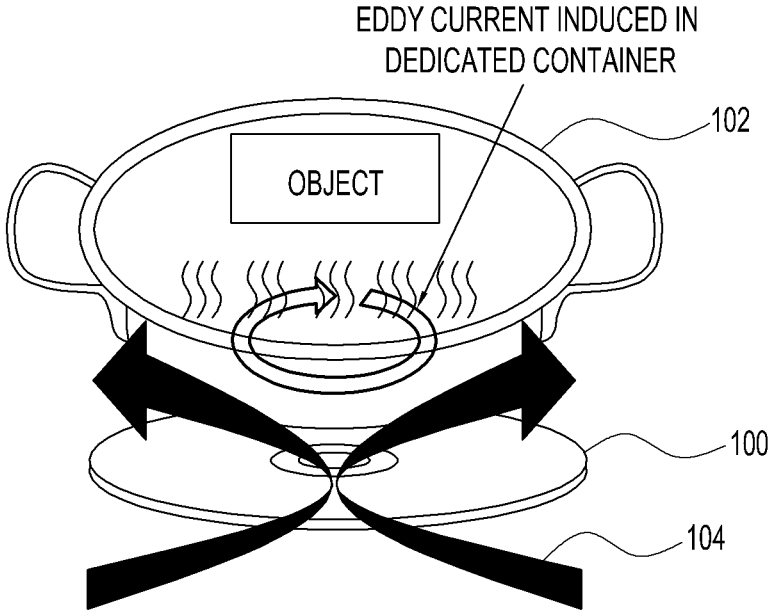
FIG. 1 is a view illustrating a heating method by an apparatus according to an embodiment of the present disclosure.
Figure 1:
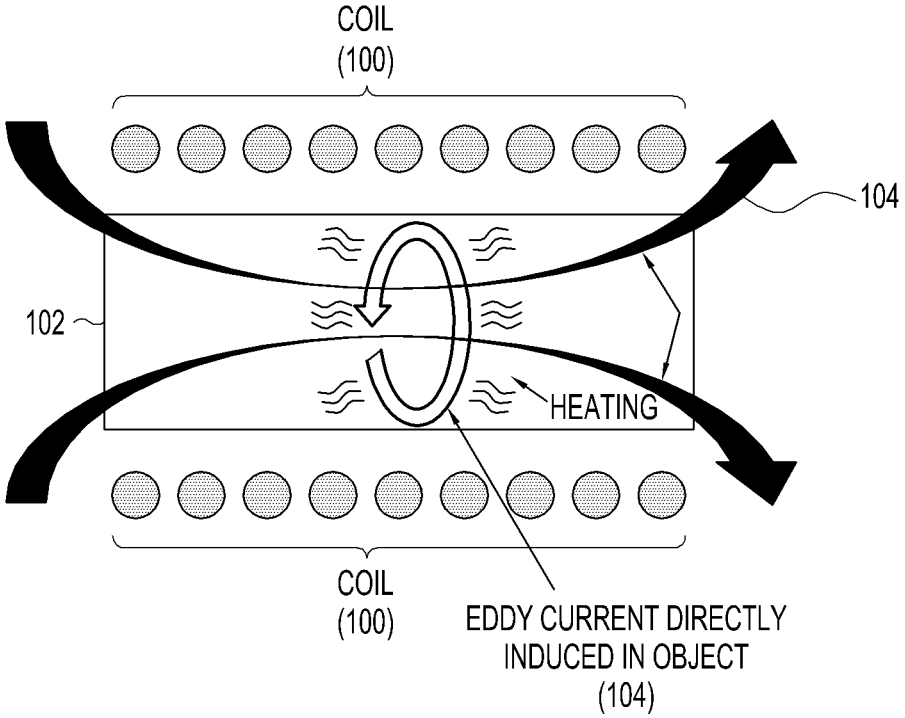

FIG. 1 is a view illustrating a heating method by an apparatus according to an embodiment of the present disclosure.

Referring to FIG. 1, a coil 100 may be provided outside a housing or container 102 where the object is to be placed inside the housing 102. The coil 100 generates a magnetic field 106 that may induce an eddy current 104 through the object so that the object may be heated up directly through a loss due to the eddy current. According to an embodiment of the present disclosure, when direct heating based on an eddy current is implemented, the object may be heated simultaneously internally and externally.

Figure 2:
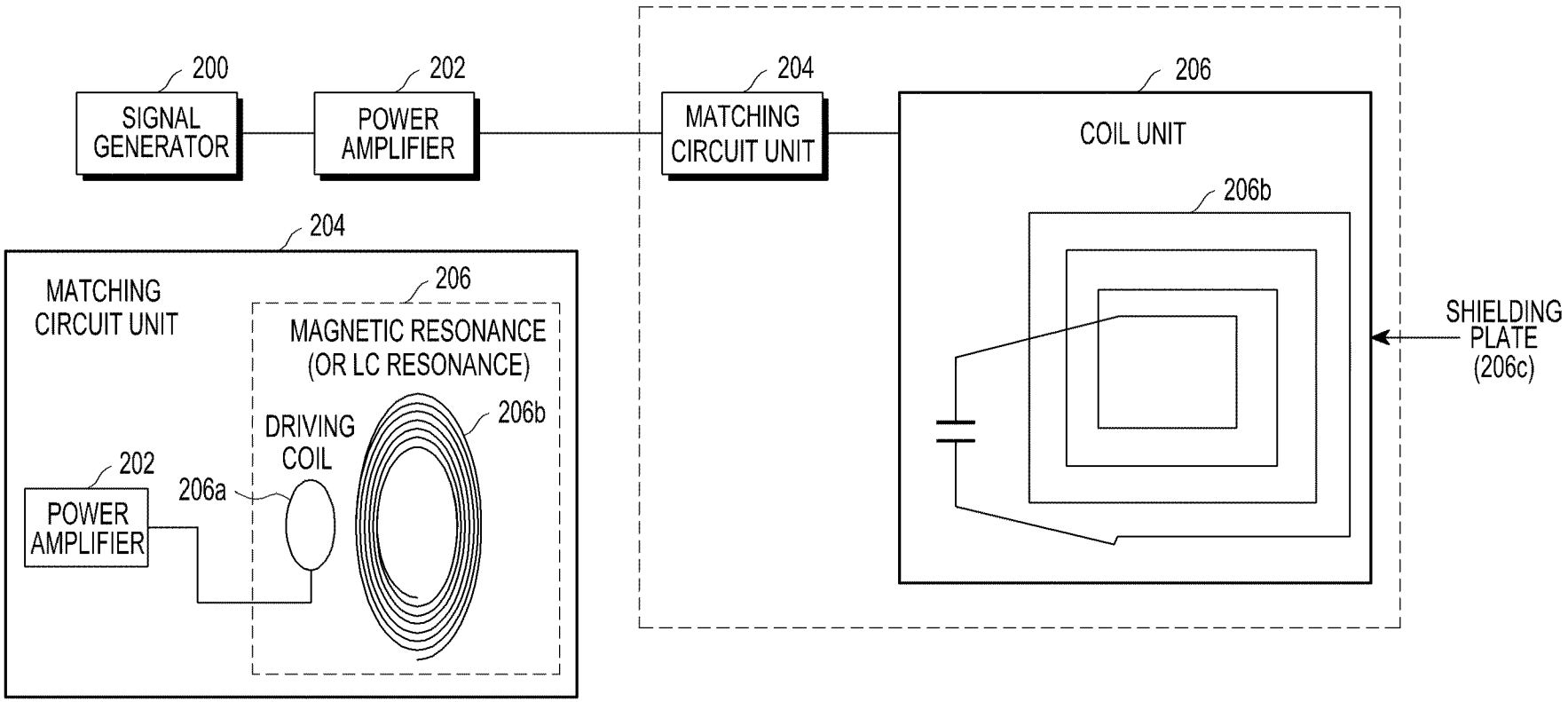
FIG. 2 is a view illustrating an example of an additional coil controlling configuration provided in an apparatus according to an embodiment of the present disclosure.

FIG. 2 illustrates additional components for controlling a coil unit provided in an apparatus according to an embodiment of the present disclosure.

Referring to FIG. 2, the apparatus according to an embodiment of the present disclosure includes additional components for controlling coils provided in inner walls of a housing having the object placed therein, as shown in FIG. 1. The additional components include, e.g., a signal generator 200 generating an operation frequency to induce or generate a current through the coil unit 206 and a power amplifier 202 amplifying the operation frequency generated by the signal generator 200 to a predetermined level.

Although not illustrated in FIG. 2, the coil unit 206 is disposed in inner walls of the housing that may contain the object as described in connection with FIG. 1. The coil unit 206 includes a driving coil 206*a* (also referred to as a "driving loop") operating upon receiving the amplified frequency from the power amplifier 202 and a helical coil 206*b*. A shielding plate 206*c* may surround the exterior of the coil unit 206 to maximize the strength of the magnetic field generated by the helical coil 206*b* of the coil unit 206. The shielding plate 206*c* may be formed of, e.g., a metal.

According to an embodiment of the present disclosure, upon the driving coil 206*a* receiving the operation frequency, a self-resonant frequency is induced at the helical coil 206*b* to generate an eddy current. According to an embodiment of the present disclosure, the operation frequency is assumed to be a relatively high frequency, e.g., 40.68 MHz, in a low-frequency band. According to an embodiment of the present disclosure, although not illustrated in the drawings, a capacitor may be connected in series with the helical coil 206*b* to form a LC resonance at the operation frequency. According to another embodiment of the present disclosure, multiple helical coils 206*b* may surround the inside of the housing.

In addition, according to another embodiment of the present disclosure, the matching circuit unit 204 is arranged between the power amplifier 202 and the coil unit 206 to adjust the strength of the magnetic fields generated through the helical coil 206*b* corresponding to an impedance Z of the object where the impedance Z is based on the defrosted state of the object. Specifically, inductive coupling may be used between the driving coil 206*a* and the helical coil 206*b* in order for the matching circuit unit 204 to provide impedance matching between the power amplifier 202 and the coil unit 206 (or a resonant coil).

Figure 3A:
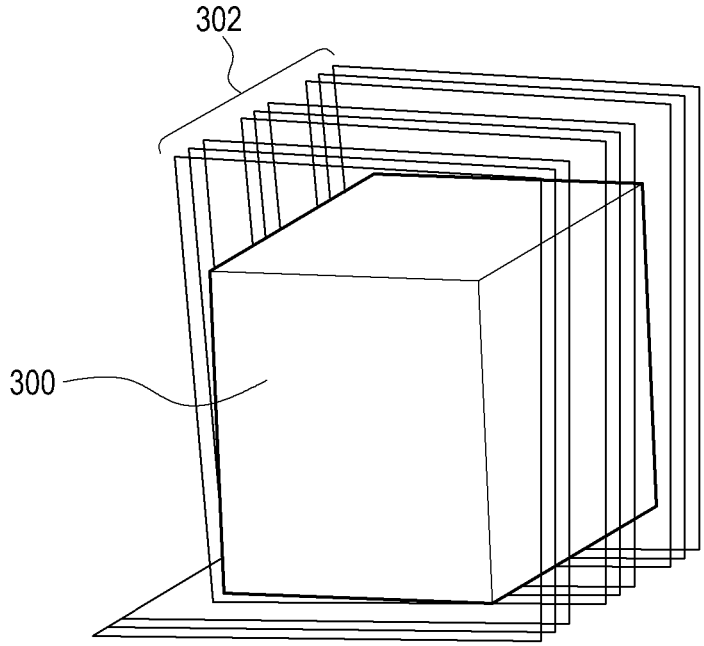
FIGS. 3A, 3B, and 3C are views illustrating examples of configurations in which multiple helical coils are positioned outside a housing according to various embodiments of the present disclosure.
Figure 3B:
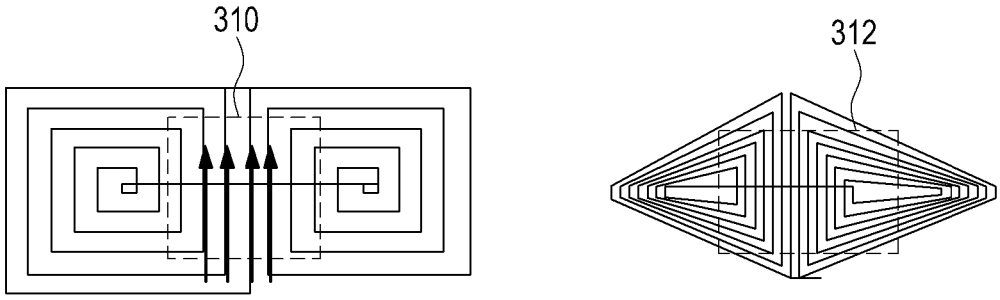
Figure 3C:
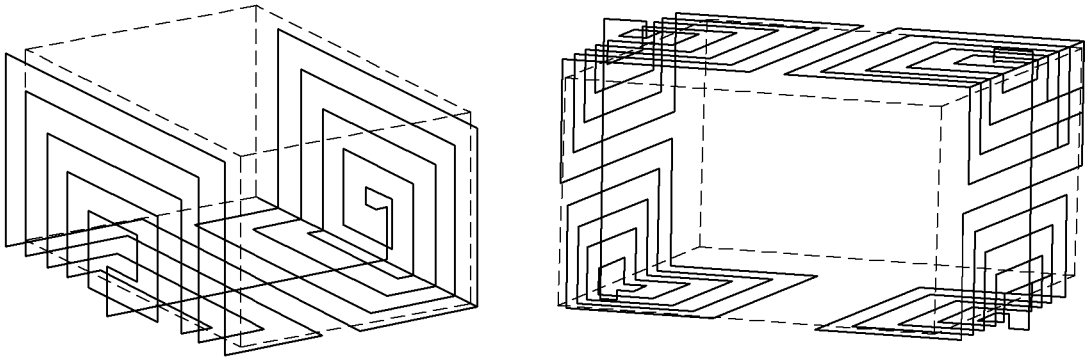

FIGS. 3A, 3B, and 3C are views illustrating examples of configurations in which multiple helical coils are positioned outside a housing according to various embodiments of the present disclosure.

Referring to FIG. 3A, helical coils 302 may be disposed in an inner wall of the housing to surround an object 300, according to an embodiment of the present disclosure.

When multiple helical coils 302 are arranged inside the housing as shown in FIG. 3A, the strength of the magnetic fields induced inside the housing may increase as compared with the magnetic field induced using a single helical coil. According to an embodiment of the present disclosure, the coil unit disposed inside the housing may be configured so that multiple helical coils are connected in parallel as shown in FIG. 3B or are connected via a power distributer. In such case, the magnetic fields may become dense where the helical coils are positioned adjacent each other (e.g., portions 310 and 312) because the currents are flowing in the helical coils in the same direction. Thus, the object inside the housing may be further heated up. Alternatively, the helical coils arranged inside the housing may be shaped to surround the object in the housing as shown in FIG. 3C. In other words, the multiple helical coils may be formed in rectangular or trapezoidal shapes corresponding to the shape of inner walls of the housing. In this case, the magnetic field may be more evenly applied to the object.

Typically, when an object is frozen, defrosting is slowed down within the object because it is difficult for the frozen object to absorb a magnetic field due to a weak dielectric nature created by the frozen state of the object.

Figure 4A:
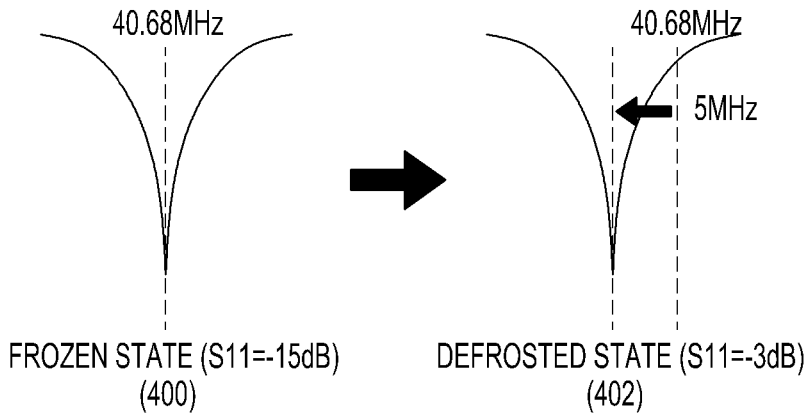
FIG. 4A is a view illustrating an example of a frequency variation as per an impedance variation that occurs as the temperature of an object increases according to an embodiment of the present disclosure.

FIG. 4A is a view illustrating an example of a frequency variation as per an impedance variation that occurs as the temperature of an object increases according to an embodiment of the present disclosure.

Referring to FIG. 4A, as the object in a frozen state 400 heats up and thus reaches a defrosted state 402 corresponding to a predetermined temperature, a frequency variation by about 5 MHz occurs. The frequency in the defrosted state 402 is lower than the frequency in the frozen state 400. In other words, as the object is defrosted (generally, when the frozen object reaches 0° C.), the dielectric-like nature of the object increases, increasing the absorption of magnetic field and reducing the defrosting time.

Figure 4B:
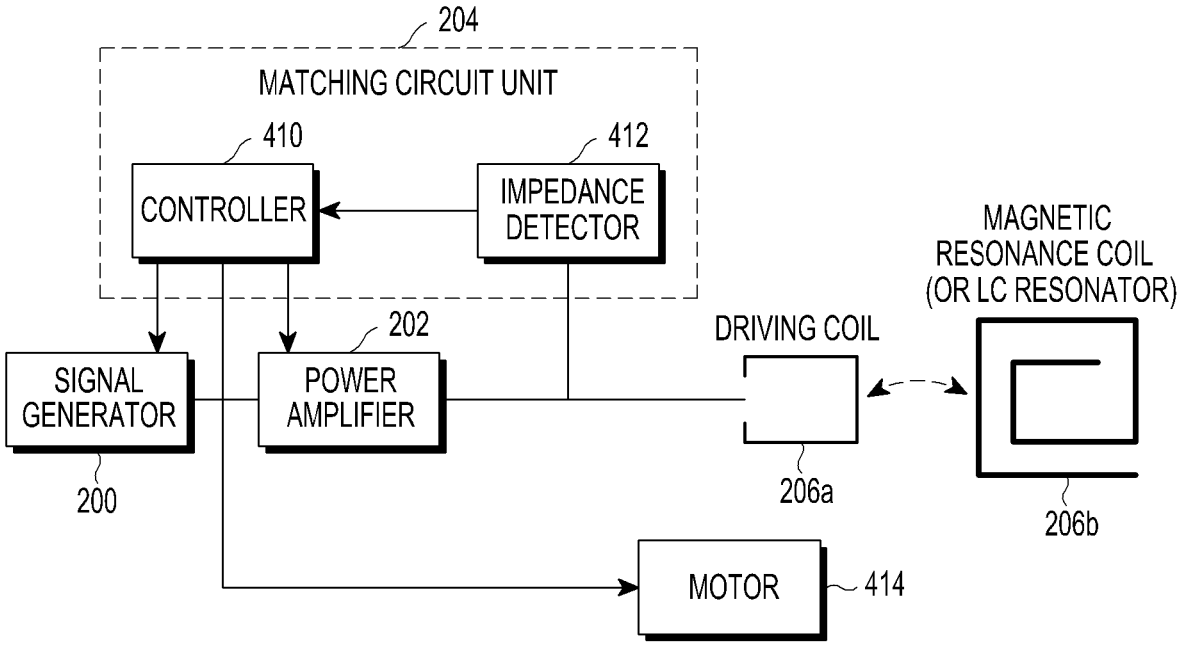
FIG. 4B is a block diagram illustrating a matching circuit unit according to an embodiment of the present disclosure.

FIG. 4B is a block diagram illustrating a matching circuit unit according to an embodiment of the present disclosure.

Referring to FIG. 4B, an impedance detector 412 monitors the impedance of a LC resonator or helical coil 206*b* and transmits the detected impedance to a controller or at least one processor 410. The controller 410 compares the detected impedance of the LC resonator or helical coil 206*b* with the impedance of the power amplifier 202. When the controller 410 determines that the detected impedance value of the LC resonator or helical coil 206*b* is different from the impedance of the power amplifier 202, the controller 410 controls a motor 414 to move the driving coil 206*a* with respect to the helical coil 206*b* so that the detected impedance value of the LC resonator or helical coil 206*b* is substantially the same as the impedance of the power amplifier 202. For example, the controller 410 may modify the impedance of the LC resonator or helical resonant coil 206*b* to be identical with or substantially similar to the impedance of the power amplifier 202 by controlling the motor 414 so that a center of the driving coil 206*a* is positioned in line with a center of the helical coil 206*b*. According to an embodiment of the present disclosure, the controller 410 determines that the object is defrosted (i.e., the state of the object is substantially thawed) when an impedance variation remains a threshold or more for a predetermined time through the impedance detector 412. Further, when an impedance value detected through the impedance detector 412 corresponds to a predetermined value, the controller 410 may obtain a time of terminating the heating of the object. Thus, when a predetermined time elapses, the controller 410 may power off the signal generator 200 and the power amplifier 202 to stop heating.

According to an embodiment of the present disclosure, a quick defrosting technique using a legacy high-frequency heating scheme is provided. An example of such apparatus may be a microwave oven. According to an embodiment of the present disclosure, an object may be subject to two-step heating. In other words, the two-step heating includes defrost heating (e.g., heating associated with defrosting the object from a frozen state to a substantially thawed state) and even heating (e.g., heating associated with cooking the object) using a resonant coil.

Figure 5A:
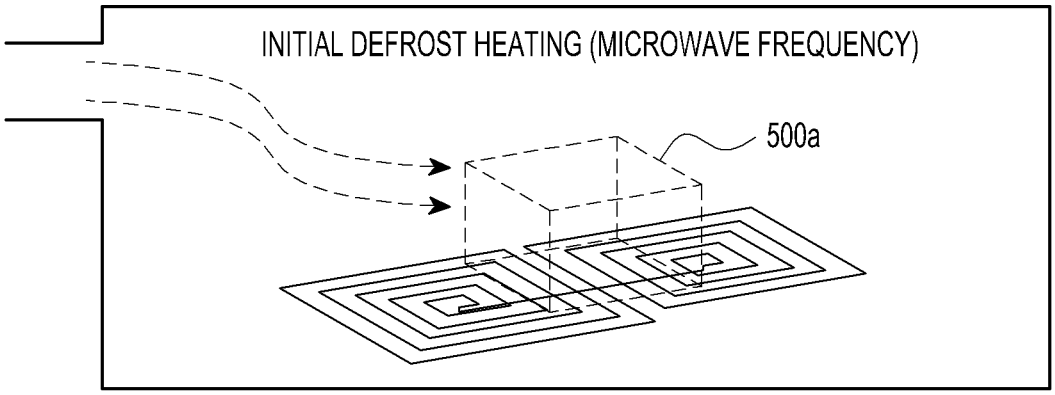
FIG. 5A is a view illustrating an example of defrost heating in quick defrosting using a microwave oven according to an embodiment of the present disclosure.

FIG. 5A is a view illustrating an example of defrost heating using a microwave oven according to an embodiment of the present disclosure.

Referring to FIG. 5A, according to an embodiment of the present disclosure, an object 500*a* (e.g., in a frozen state) is heated using a microwave frequency for a predetermined short time (hereinafter, referred to as a "defrost heating period"). In this case, the defrost heating period is a period of time immediately before until the speed at which the object thaws (e.g., rate of change in temperature of the object) is drastically increased. For example, the defrost heating period may be set to a time corresponding to when a variation in a monitored thawing speed of the object is greater than a predetermined threshold value.

Figure 5B:
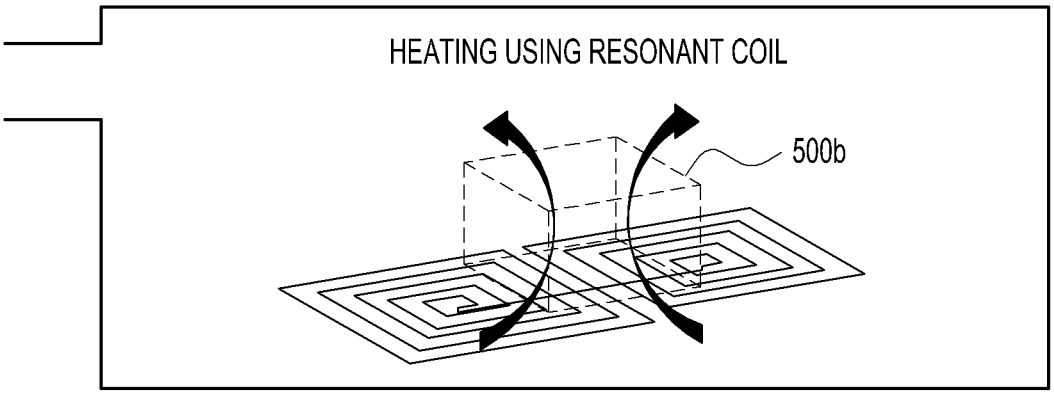
FIG. 5B is a view illustrating an example of even heating using a resonant coil in quick defrosting using a microwave oven according to an embodiment of the present disclosure.

FIG. 5B is a view illustrating an example of even heating using a resonant coil using a microwave oven according to an embodiment of the present disclosure.

Referring to FIG. 5B, according to an embodiment of the present disclosure, resonant coils as described supra in relevant embodiments (for example, driving coil 206*a* and helical coil 206*b* of coil unit 206) are used to heat the object 500*b* such that the object cooks internally and externally at even speed. The even heating using resonant coils, here, is substantially the same as the resonant coil-based heating described above, and no further detailed description thereof is given.

Figure 6:
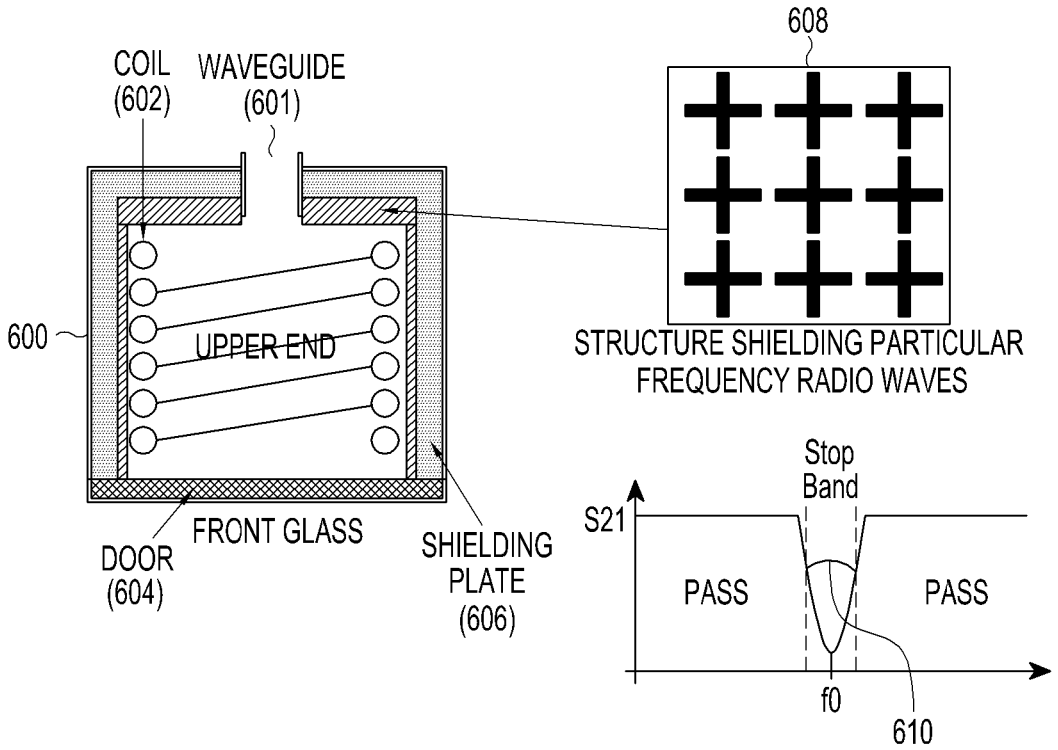
FIG. 6 is a view illustrating an example of a configuration of an apparatus operating based on defrost heating and even heating according to an embodiment of the present disclosure.

FIG. 6 is a view illustrating an example of a configuration of an apparatus operating based on defrost heating and even heating according to an embodiment of the present disclosure.

Referring to FIG. 6, according to an embodiment of the present disclosure, the apparatus 600 may include, e.g., a waveguide 601, a coil 602, a door 604, a shielding plate 606, and a shielding structure 608 for shielding a particular frequency.

The waveguide 601 may be disposed in one or more of the walls of the apparatus 600, except for the door 604, to apply power having a microwave frequency band corresponding to a few GHz to the apparatus 600 during the defrost heating period. A cross section of an inlet of the waveguide 601 may be positioned to be in parallel with a cross section of the coil 602.

A coil 602 for even heating as described above is disposed along the inner walls of the apparatus 600. The coil 602 here may be configured as described above in relevant embodiments (e.g., coil unit 206), and the description thereof is not repeated.

The door 604 may be configured as a hinged door to put an object in or out of the housing inside the apparatus 600 and a portion of the door 604 may include glass to allow to visually perceive the heated state of the object.

The shielding plate 606, formed of a metal, is attached onto outermost surfaces of the apparatus 600, except for the door 604, for the purpose of shielding electromagnetic interference (EMI). In addition, the shielding structure 608 (e.g., a frequency selective surface (FSS) cover) for shielding a particular frequency band 610 may be attached on an inner surface of the shielding plate 606. By attaching the shielding structure 608 to the shielding plate 606, the shielding plate 606 shields EMI for frequency bands other than the particular frequency band 610, e.g., a low frequency band while the shielding structure 608 functions shields EMI for the particular frequency band 610, e.g., a microwave frequency band.

Figure 7:
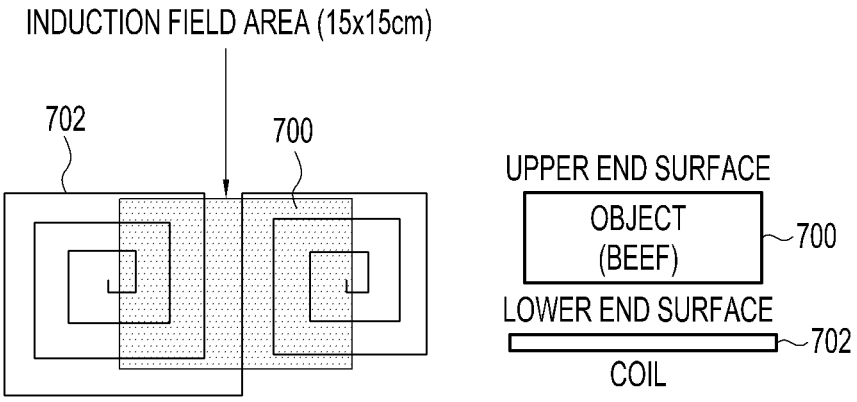
FIG. 7 is a view illustrating an example of a result of heating by an apparatus according to an embodiment of the present disclosure.

FIG. 7 is a view illustrating an example of a result of heating by an apparatus according to an embodiment of the present disclosure. FIG. 7 is a graph illustrating a result of heating 80 g of frozen beef whose surface temperature is −7° C. by an apparatus as illustrated in FIG. 2. The beef is assumed to have a rectangular prism shape that is 5 cm long, 5 cm wide, and 3 cm high.

Referring to FIG. 7, a portion of the beef 700 (the object to be heated) that contacts an upper surface of a coil 702 disposed outside a housing of the apparatus as shown in FIG. 2, is defined as a "lower end surface," and a portion of the beef 700 positioned at the ceiling of the housing is defined as an "upper end surface." Two helical coils 702 as shown in FIG. 7 are used.

Comparison is made between when the beef meeting the above-enumerated conditions is thawed at room temperature and when the beef is thawed by heat generated by the apparatus. For the case where the beef is thawed at room temperature, the upper end surface and the lower end surface, i.e., the bottom, are assumed to present the same temperature difference, and thus, both the upper end surface and the lower end surface are denoted as "SURFACE" in the table illustrated in FIG. 7.

As a result of heating the beef 700 at a power of 63 W in the apparatus, the temperature of the upper end surface of the beef 700 has increased from an initial temperature of −7° C. to 3° C. after five minutes whereas when the beef 700 is thawed at room temperature an increase to −3° C. is shown after five minutes. Ten minutes thereafter, the temperature of the beef 700 thawed at room temperature increases to −2.3° C., which is a small increase in temperature as compared with the temperature measured five minutes earlier. In contrast, the heating of the beef 700 in the apparatus leads to a significant temperature increase, such as to 4° C. for the upper end surface and 8° C. for the lower end surface.

Figure 8:
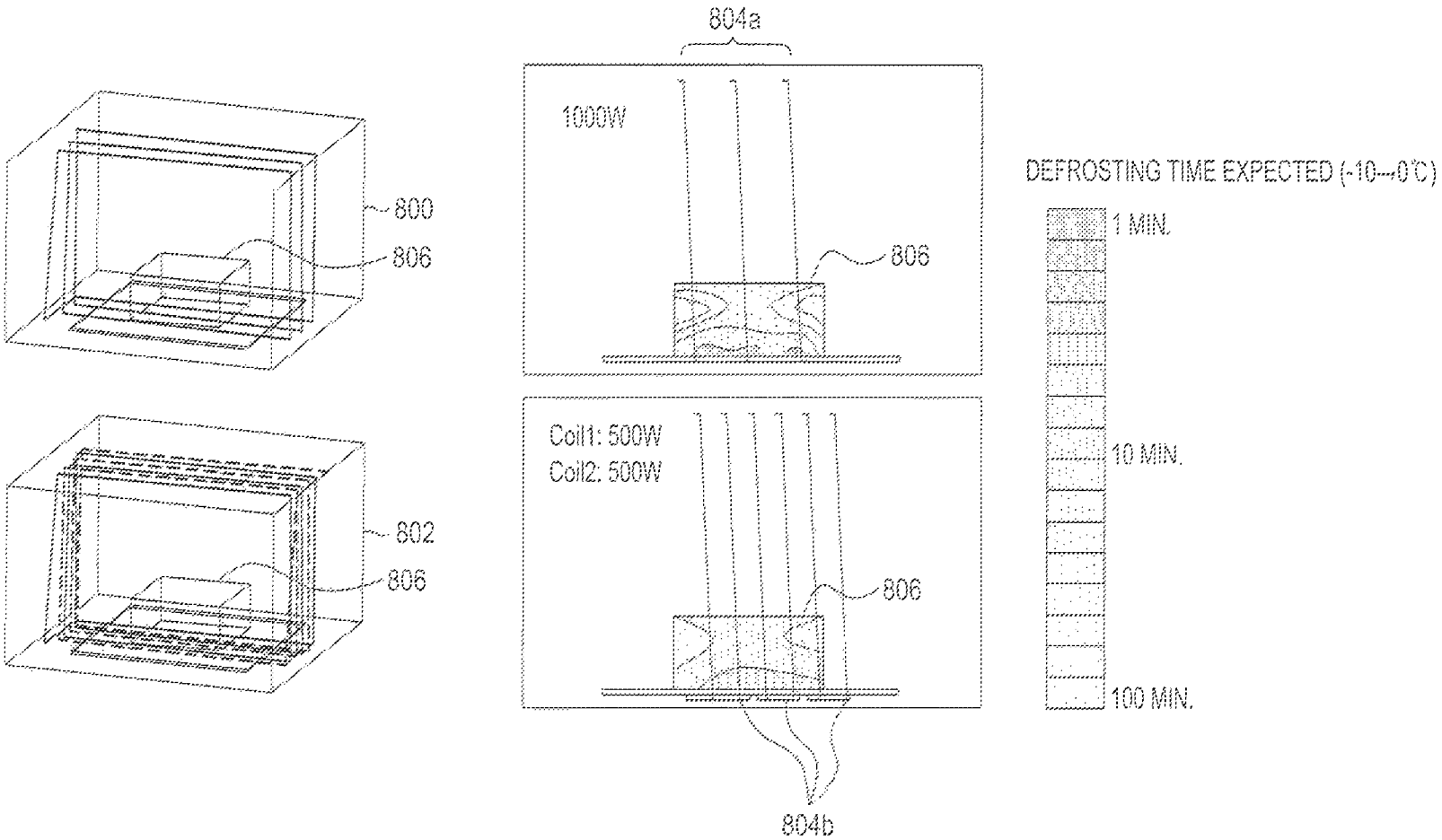
FIG. 8 is a view illustrating a result of heating by an apparatus adopting multiple coils according to an embodiment of the present disclosure.

FIG. 8 is a view illustrating a result of heating by an apparatus adopting a different number of helical coils according to an embodiment of the present disclosure.

Referring to FIG. 8, a first apparatus 800 includes a single helical coil 804*a* disposed in a housing, and a second apparatus 802 includes two helical coils 804*b* disposed in a housing. As the same power, 1000 W, is applied to each apparatus, the whole 1000 W power is applied to the single helical coil 802*a* in the first apparatus 800, and 500 W power is applied to each of the two helical coils 804*b* in the second apparatus 802.

As a result obtained by heating an object 806 for ten minutes, the object 806 remains frozen at −10° C. when using the first apparatus 800 and the second apparatus 802. However, when the second apparatus 802 is used to defrost the object 806, the object 806 exhibits a more even heat distribution. FIG. 8 illustrates an example of mapping temperatures corresponding to expected defrosting times with different colors.

The sample defrosted by the first apparatus 800 shows varying internal temperatures of the object 806 (e.g., five different temperature values) which correspond to different expected defrosting times. In contrast, the object 806 defrosted in the apparatus 802 is defrosted relatively evenly, overall presenting a reduced number of varying internal temperatures (e.g., three different temperature values).

Figure 9:
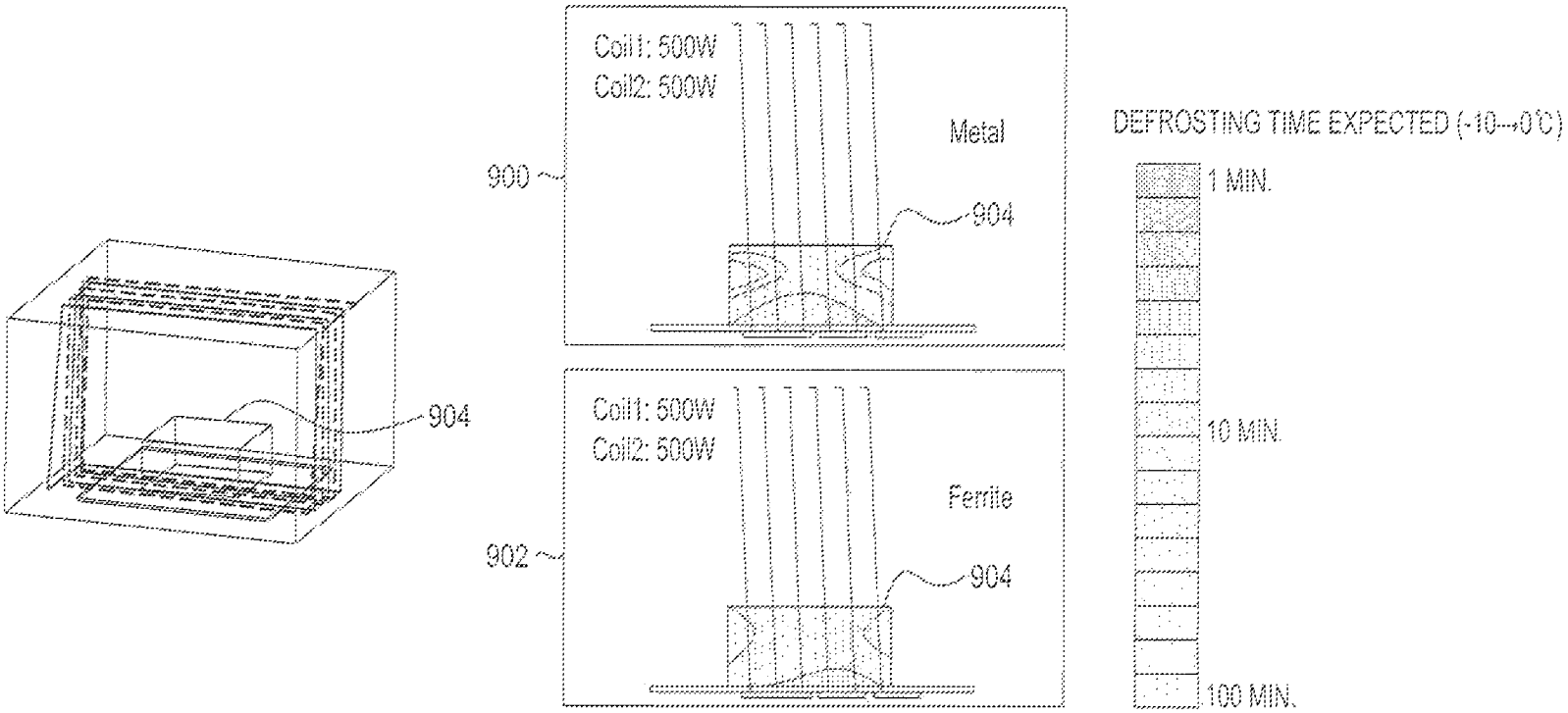
FIG. 9 is a view illustrating defrosting times expected respectively for when no shielding plate is mounted on outer walls of an apparatus and when a metallic shielding plate is mounted on outer walls of an apparatus according to an embodiment of the present disclosure.

FIG. 9 is a view illustrating expected defrosting times respectively for when no shielding plate is mounted on outer walls of a first apparatus and when a shielding plate is mounted on outer walls of a second apparatus according to an embodiment of the present disclosure.

Referring to FIG. 9, for convenience of description, the first apparatus 900 and the second apparatus 902 are assumed to be based on apparatus 802 where the apparatus 900 does not include a shielding plate and the second apparatus 902 includes a shielding plate.

As illustrated in FIG. 9, when the second apparatus 902 is used to heat an object 904, a heat distribution associated with the object 904 includes temperatures corresponding to expected defrosting times (e.g., 10 minutes before and after), and thus the similarly expected defrosting time as a whole. Alternatively, when the first apparatus 900 with no shielding plate is used to heat the object 904, the heat distribution associated with the object 904 results includes temperatures corresponding to expected defrosting times (e.g., 100 minutes before and after) where the portions of the object 904 positioned relatively close to the walls of the first apparatus 900 being associated with lower temperatures which correspond to relatively longer defrosting times and where a center of the object 904 temperatures corresponding to expected defrosting times (e.g., 10 minutes before), thus an expected defrosting time of each of positions of the object 904 is different each other.

Figure 10:
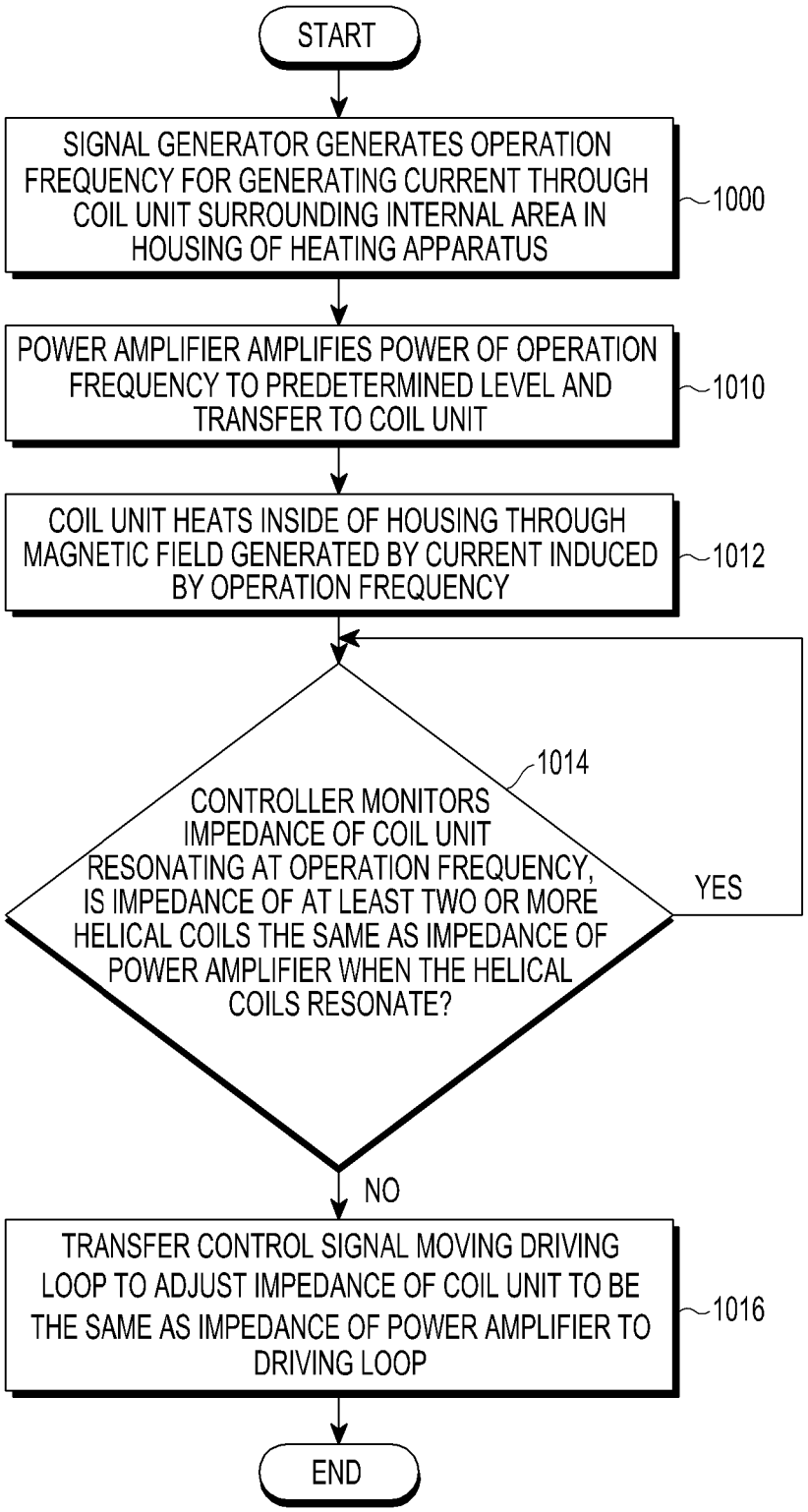
FIG. 10 is a flowchart illustrating operations of an apparatus performing heating using low-magnetic electric fields according to an embodiment of the present disclosure.

FIG. 10 is a flowchart illustrating operations of an apparatus performing heating using low-magnetic electric fields according to an embodiment of the present disclosure. The method will be discussed with reference to the exemplary apparatuses illustrated in FIGS. 2 and 4B. However, the method can be implemented with any suitable device. In addition, although FIG. 10 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined, and/or adapted in various ways.

Referring to FIG. 10, in operation 1000, the signal generator 200 generates an operation frequency for generating a current through the coil unit 206 surrounding the internal area of the apparatus housing and provides the operation frequency to the power amplifier 202. According to an embodiment of the present disclosure, the operation frequency is assumed to be a relatively high frequency, e.g., 40.68 MHz, in a low-frequency band. According to another embodiment of the present disclosure, although not illustrated in the drawings, a capacitor may be connected in series with the helical coil 206*b* to form a LC resonance at the operation frequency.

In operation 1010, the power amplifier 202 amplifies the power of the operation frequency to a predetermined level and provides the amplified power to the coil unit 206. Here, the coil unit 206 includes the driving coil 206*a* and the helical coil (or LC resonator) 206*b*.

In operation 1012, the coil unit 206 heats an object placed in the housing through a magnetic field generated by a current generated due to the operation frequency.

In operation 1014, the controller 410 monitors the impedance of the coil unit 206 resonating at the operation frequency and when at least two or more helical coils 206*b* resonate, the controller 410 determines whether the impedance of the at least two or more helical coils 206*b* is substantially similar to the impedance of the power amplifier 202. Although an example is described for description purposes in which the operation of the impedance detector 412 is carried out by the controller 410, the impedance detector 412 may be configured and operated independently from the controller 410 as shown in FIG. 4B.

When the impedance of the at least two or more helical coils 206*b* is determined to be different from the impedance of the power amplifier 202, the controller 410 in operation 1016 transmits, to the driving coil 206*a*, a control signal allowing the driving coil 206*a* to be moved so that the impedance of the coil unit 206 becomes identical or substantially similar to the impedance of the power amplifier 202. In an exemplary embodiment, the controller 410 modifies the impedance of the LC resonator or helical resonant coil 206*b* to be identical with or substantially similar to the impedance of the power amplifier 202 by controlling the motor 414 to move the driving coil 206*a* such that a center of the driving coil 206*a* is positioned in line with a center of the helical resonant coil 206*b*.

When the impedance of the at least two or more helical coils 206*b* is determined to the same as the impedance of the power amplifier, the controller 410 returns to operation 1014 to repeat the monitoring operation.

Meanwhile, although not illustrated in the drawings, the controller 410 may determine a time of terminating the heating of the object when the detected impedance value reaches a predetermined value. In this case, when a predetermined time elapses, the controller 410 may power off the signal generator 200 and the power amplifier 202 to stop heating.

While the method was described with respect to apparatuses associated with FIGS. 2 and 4B, this method may also be performed in the apparatus illustrated in FIG. 6. In addition, this method may also be implemented in an apparatus that may heat an object at two steps, i.e., a defrost heating step and an even heating such as that described above in connection with FIGS. 5A and 5B, and no further description thereof is presented.

According to an embodiment of the present disclosure, there is suggested a container configured with multiple resonant coils corresponding to the type or number of objects to be heated. The container may be provided as a separate component from the apparatus evenly heating an object using a low-frequency magnetic field as described above. According to an embodiment of the present disclosure, multiple objects may be placed in the container that is then placed in the housing 102 of FIG. 1 and may simultaneously be heated.

Figure 11:
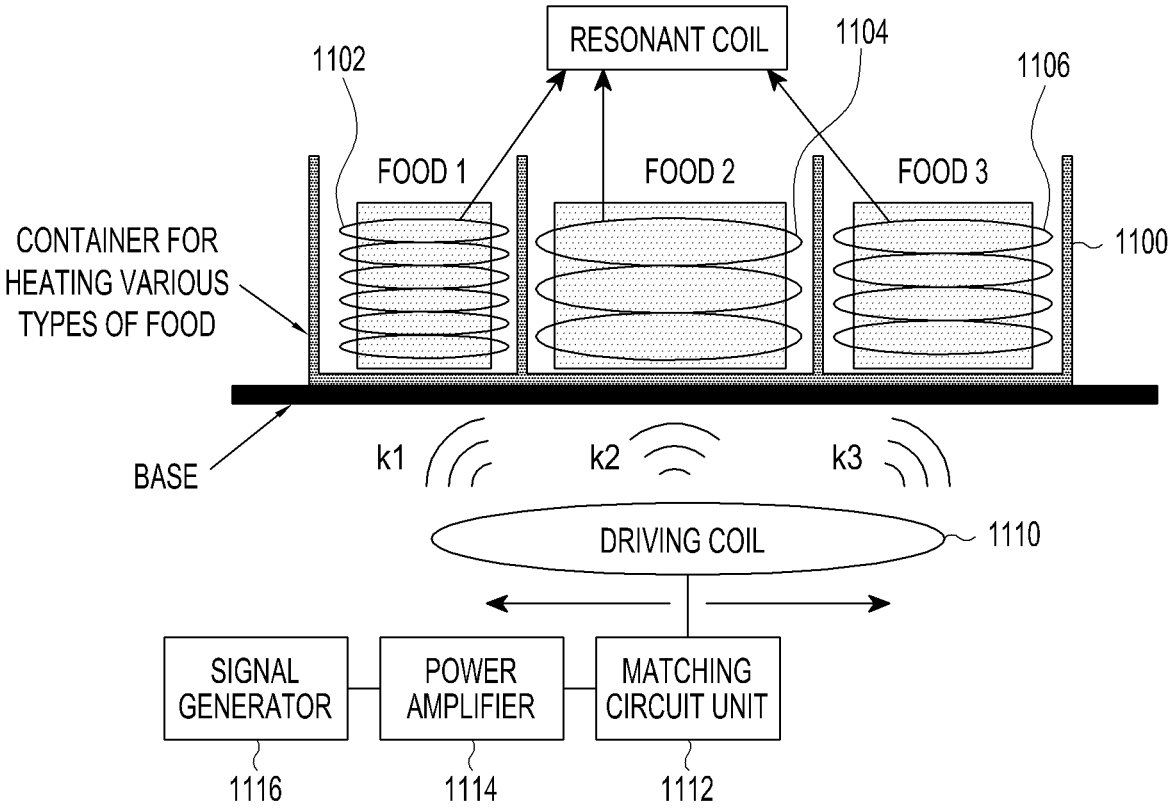
FIG. 11 is a view illustrating an example in which a housing includes a container for simultaneously heating different types of objects according to an embodiment of the present disclosure.

FIG. 11 illustrates an example of simultaneously heating different types of objects in a container in a housing according to an embodiment of the present disclosure.

Referring to FIG. 11, according to an embodiment of the present disclosure, the container 1100 includes three independent spaces for containing objects (e.g., FOOD 1, FOOD 2, FOOD 3) where a resonant coil may be installed on an inner wall of each of the spaces. For example, a first resonant coil 1102 is installed in a first space containing FOOD 1, a second resonant coil 1104 is installed in a second space containing FOOD 2, and a third resonant coil 1106 is installed in a third space containing FOOD 3.

According to an embodiment of the present disclosure, the apparatus including a housing where the container 1100 is placed is configured similar to the configuration of the apparatus as shown in FIG. 2. The apparatus includes a signal generator 1116 generating an operation frequency for generating a current through the first resonant coil 1102, the second resonant coil 1104, and the third resonant coil 1106, an amplifier 1114 amplifying the operation frequency to a predetermined level, and a matching circuit unit 1112. The power amplified by the amplifier 1114 is transferred to a driving coil 1110 connected to the matching circuit unit 1112. The matching circuit unit 1112 compares the impedance of the first resonant coil 1102, the second resonant coil 1104, and the third resonant coil 1106 with the impedance of the power amplifier 1114 according to the heated state of each object (e.g., FOOD 1, FOOD 2, FOOD 3) included in the container 1100 and controls a motor to move the driving coil 1110 so that the impedance values become the same. The driving coil 1110 is positioned under the base of the housing, and the container 1100 is configured to be fastened to an upper end of the base.

According to an embodiment of the present disclosure, power is distributed from the driving coil 1100 to the resonant coils 1102, 1104, and 1106 installed in the spaces according to power required for the objects (FOOD 1, FOOD 2, FOOD 3). The position where each resonant coil is to be installed in the space for heating each object inside the container 1100 may be determined by a power distribution ratio required for the object based on Equation 1:

$$P1, P2, \ldots, Pi=k1^2, k2^2, \ldots, ki^2 \qquad \text{Equation 1}$$

Here, ki is the coupling coefficient between a driving coil and a resonant coil installed in a space for heating object i, and Pi is the power required upon heating object i. According to an embodiment of the present disclosure, the power distribution ratio is adjusted by the coupling coefficient between the driving coil 1100 and each resonant coil 1102, 1104, and 1106, and the coupling coefficient is adjusted by the distance between the driving coil 1100 and each resonant coil 1102, 1104, and 1106.

Alternatively, a container having a separate resonant coil installed therein for heating an object inside a resonant coil installed in another housing of an apparatus for evenly heating another object using a low-frequency magnetic field is provided. The container may also be provided as a component separate from the apparatus. For example, the object being an egg which requires a relatively high level of power as compared with a predetermined time. Thus, according to an embodiment of the present disclosure, the container having a separate resonant coil installed therein is placed and heated in the housing, so that the power from the coil installed on the wall of the housing is transferred to the container, allowing for heating at a relatively high level of power as compared with the object positioned outside the container.

Figure 12A:
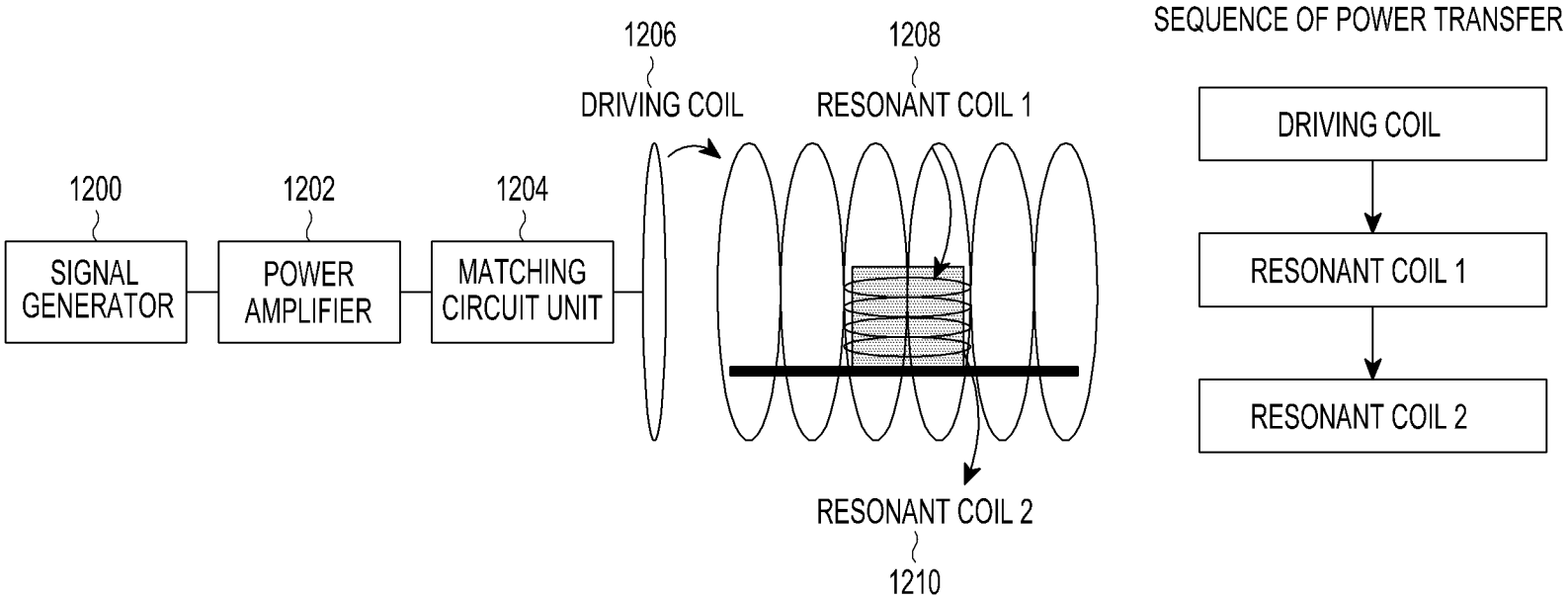
FIG. 12A is a view illustrating an operation of a container having a separate resonant coil for heating a different object inside a housing according to an embodiment of the present disclosure.

FIG. 12A is a view illustrating an operation of a container having a separate resonant coil installed therein to heat another object inside a housing according to an embodiment of the present disclosure.

Referring to FIG. 12A, according to an embodiment of the present disclosure, an apparatus including a housing where a container having a separate resonant coil, i.e., second resonant coil 1210, installed therein is to be placed includes a signal generator 1200, a power amplifier 1202, a matching circuit unit 1204, and a driving coil 1206 as described above in connection with FIG. 2. The signal generator 1200 generates an operation frequency of a first resonant coil 1208 installed on the wall of the housing and the power amplifier 1202 amplifies the power to a predetermined level and transfers the power to the driving coil 1206. The matching circuit unit 1204 compares the impedance of the power amplifier with the impedance of the first resonant coil 1208 and moves the distance of the driving coil 1206 to allow the impedance values to be identical to each other. The driving coil 1206 may be provided under the first resonant coil 1208 or to surround the first resonant coil 1208.

According to an embodiment of the present disclosure, the second resonant coil 1210 is positioned where the power density is maximized inside the housing having the first resonant coil 1208 installed therein. The first resonant coil 1208 is a helical coil. Generally, a helical coil, by nature, has the maximum power density at a center thereof Thus, the second resonant coil 1210 is rendered to be positioned at a center of the first resonant coil 1208 of the housing using such nature. The second resonant coil 1210 resonates at the same frequency as the first resonant coil 1208. Then, as the power from the driving coil 1206 is delivered to the second resonant coil 1210 from the first resonant coil 1208, a relatively high level of power is transferred in the housing having the first resonant coil 1208 installed therein, as compared with in the space outside the container having the second resonant coil 1210 installed therein. Thus, objects requiring different levels of power inside the housing from the same time may simultaneously be heated using the container having the second resonant coil 1210 installed therein.

Figure 12B:
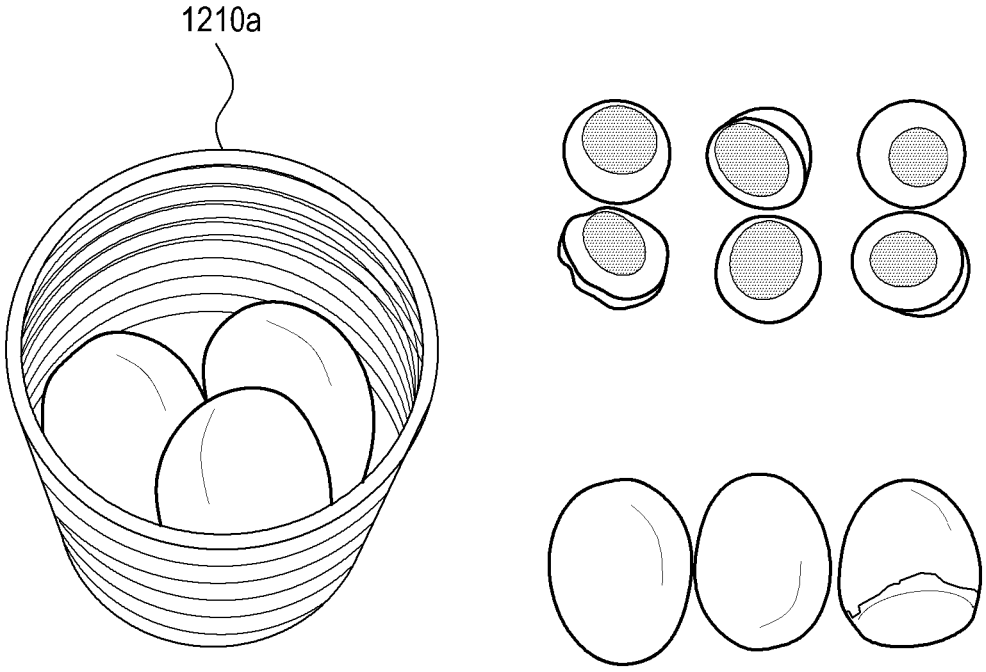
FIGS. 12B and 12C are views illustrating examples of containers each having a separate resonant coil as illustrated in FIG. 12A according to various embodiments of the present disclosure.
Figure 12C:
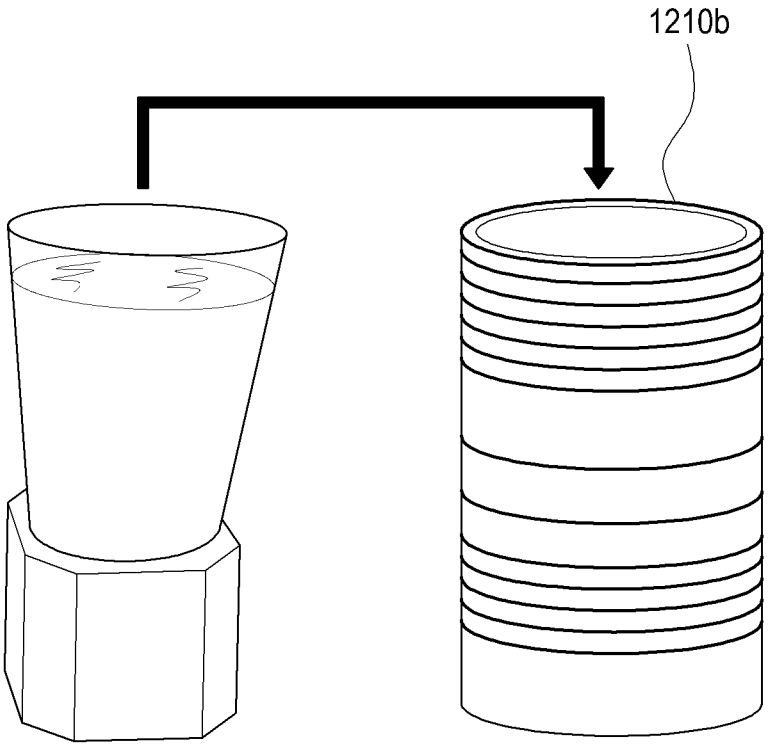

FIGS. 12B and 12C are views illustrating examples of containers each having a separate resonant coil as illustrated in FIG. 12A according to various embodiments of the present disclosure. Referring to FIG. 12B, a container 1210*a* for boiling eggs, having a resonant coil installed therein is illustrated. Referring to FIG. 12C, a dedicated container 1210*b* for warming up milk or other liquid, having a resonant coil installed therein is illustrated.

According to an embodiment of the present disclosure, an apparatus for evenly heating a broad object using a low-frequency magnetic field is provided.

Figure 13A:
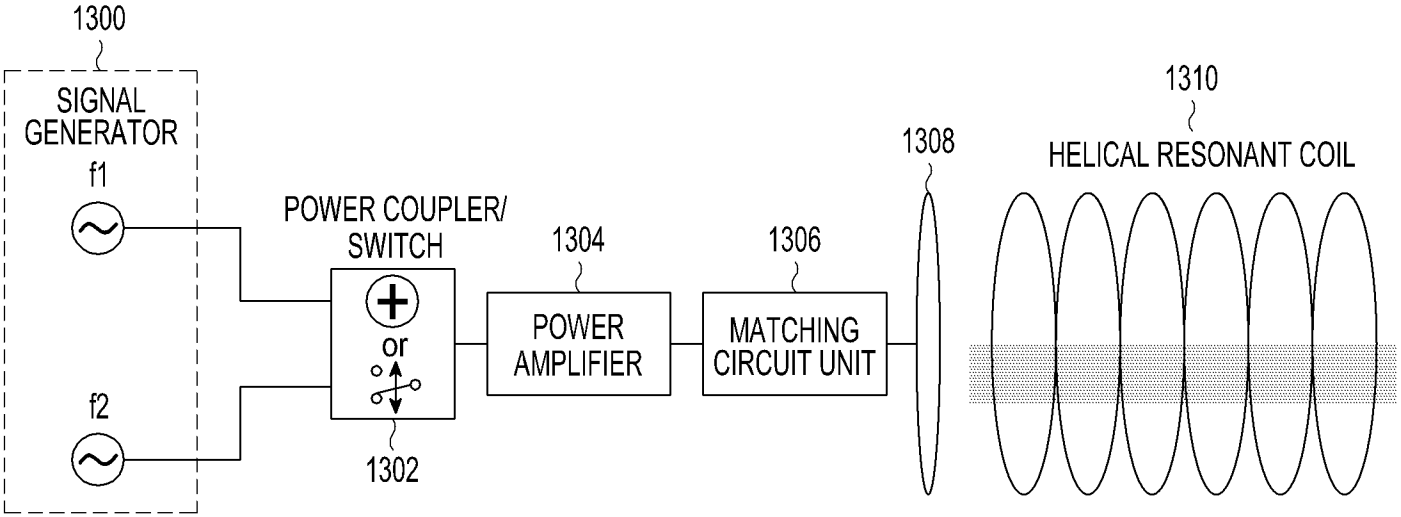
FIGS. 13A and 13B are views illustrating examples of apparatuses having a large area according to various embodiments of the present disclosure.
Figure 13B:
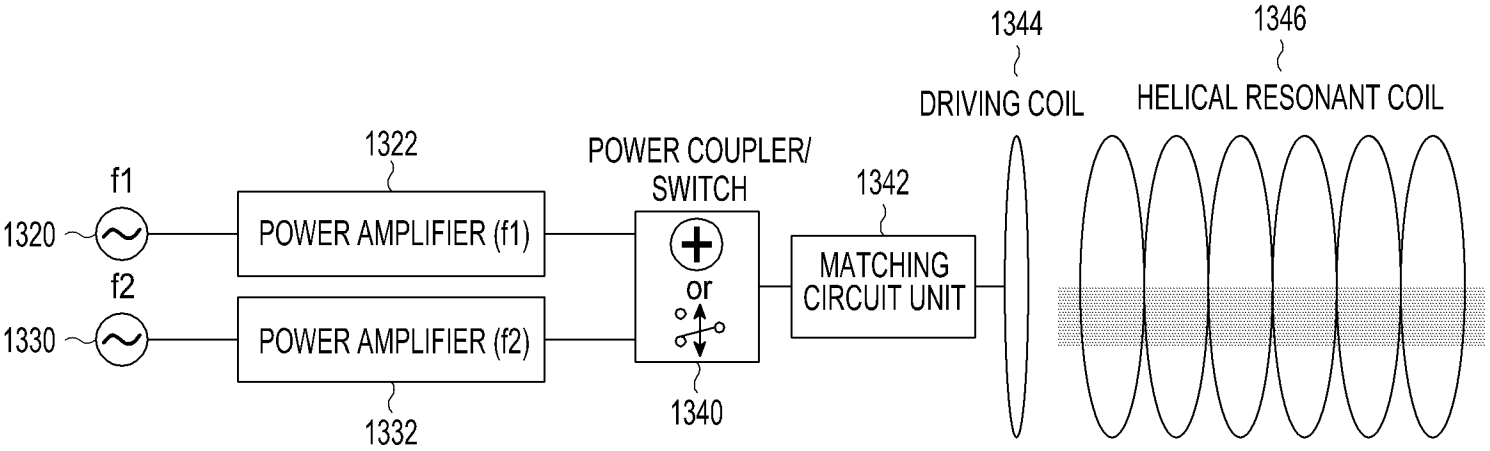

FIGS. 13A and 13B are views illustrating examples of apparatuses having a large area according to various embodiments of the present disclosure.

According to an embodiment of the present disclosure, the apparatus utilizes a multi-resonant mode for heating an object with a broad area. Thus, according to an embodiment of the present disclosure, there are two signal generators for generating two operation frequencies required for two resonant modes.

Referring to FIG. 13A, according to an embodiment of the present disclosure, the apparatus may include a signal generator 1300 including sub signal generators respectively generating different operation frequencies f1 and f2, a power coupler/switch 1302 synthesizing the two operation frequencies and simultaneously applying to a power amplifier 1304, a matching circuit unit 1306, a driving coil 1308, and a housing having a helical resonant coil 1310 installed therein. The power coupler/switch 1310 may be operated to alternately apply the two operation frequencies to the power amplifier 1304 by periodic switching of the two operation frequencies.

Referring to FIG. 13B, according to an embodiment of the present disclosure, the apparatus may include a first signal generator 1320 and a second signal generator 1330 generating different operation frequencies, i.e., f1 and f2, respectively, and a power amplifier f1 1322 and power amplifier f2 1332 for respectively amplifying the frequencies generated from the signal generators. The apparatus further includes a power coupler/switch 1340, a matching circuit unit 1342, a driving coil 1344, and a housing 1346 having a helical resonant coil installed therein. The power coupler/switch 1340 is operated in the same way as the power coupler/switch 1302 of FIG. 13A, and no further detailed description thereof is thus made.

Figure 13C:
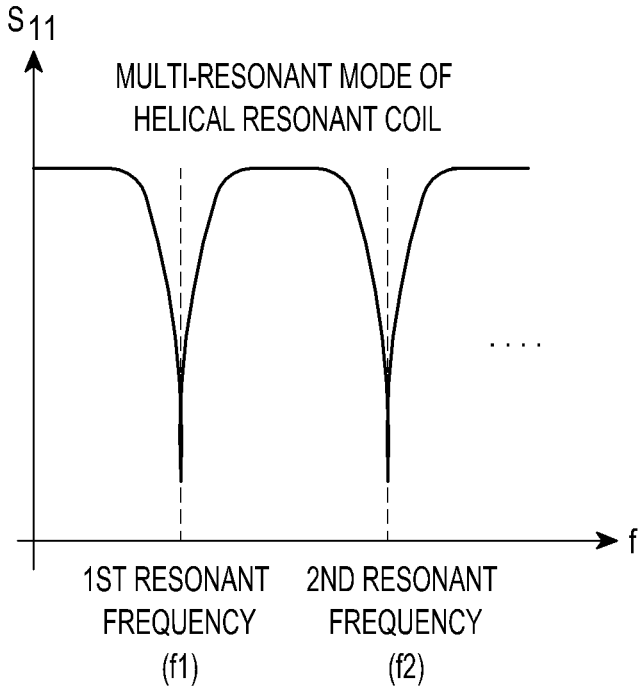
FIGS. 13C and 13D are views illustrating an example of a variation in temperature as per resonant frequency when an apparatus as illustrated in FIGS. 13A and 13B comes into use according to various embodiments of the present disclosure.
Figure 13D:
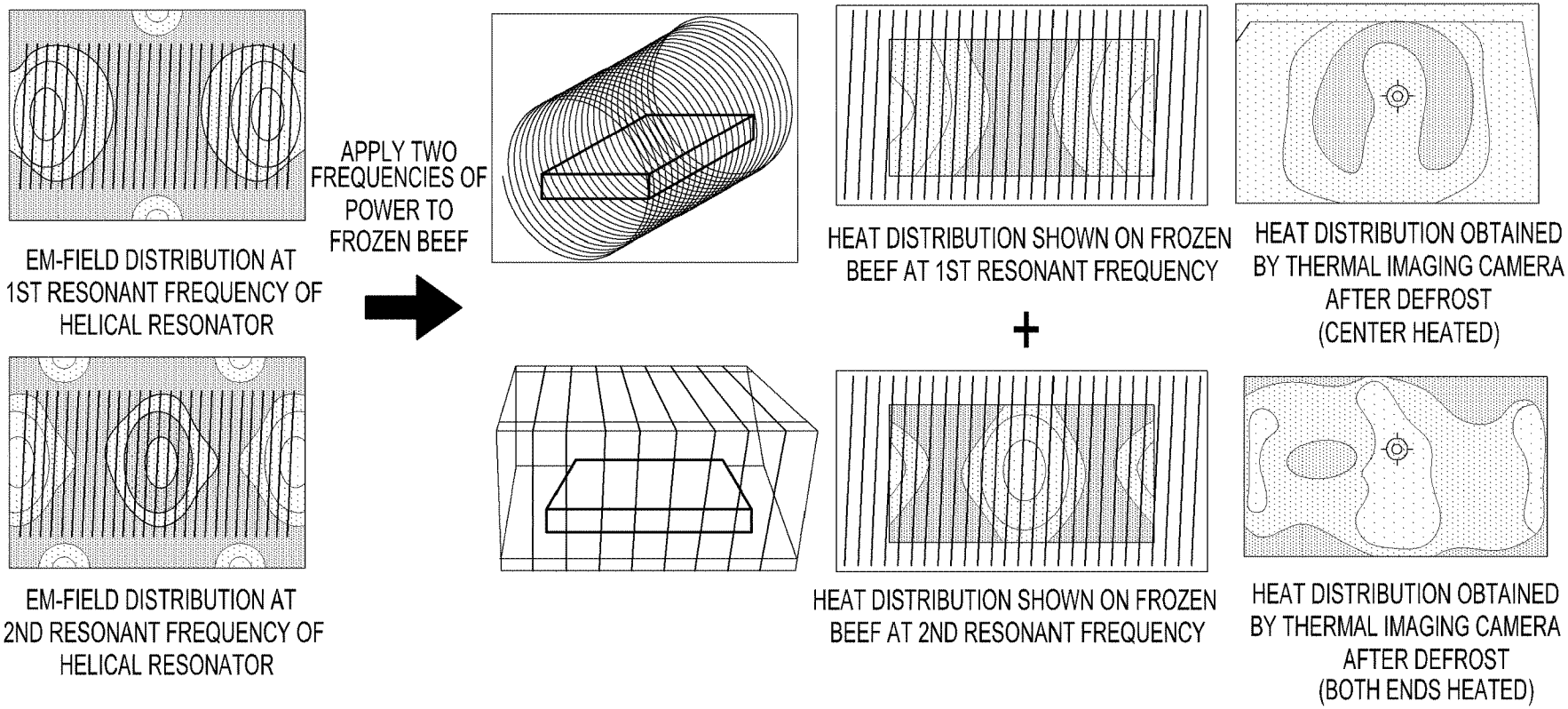

FIGS. 13C and 13D are views illustrating an example of a variation in temperature as per resonant frequency when an apparatus configured as shown in FIGS. 13A and 13B comes into use according to various embodiments of the present disclosure.

Referring to FIGS. 13C and 13D, as two operation frequencies are used, heat transfer is made inside the housing to both ends with respect to the center as compared with when one operation frequency is implemented. Thus, a spacious object may be more evenly heated by the apparatus according to an embodiment of the present disclosure.

As set forth above, an object may be heated in an even and more-cost saving manner by the configuration and operation of an apparatus according to an embodiment of the present disclosure.

While the present disclosure has been shown and described with reference to various embodiments thereof, it will be understood by those skilled in the art that various changes in form and details may be made therein without departing from the spirit and scope of the present disclosure as defined by the appended claims and their equivalents. This description is not necessarily intended to be exhaustive or to limit the invention to the precise embodiments disclosed. The specification describes specific examples to accomplish a more general goal that may be accomplished in another way. Those skilled in the art will appreciate that the features described above can be combined in various ways to form multiple variations of the invention.

What is claimed is:

1. A heating apparatus comprising:

a signal generator configured to generate an operation frequency;

a power amplifier configured to amplify power of the operation frequency to a predetermined level, and output the operation frequency of the amplified power;

a coil unit including:

a driving loop configured to operate in response to receiving the output operation frequency, and a helical coil configured to generate a current at the output operation frequency; and at least one processor configured to:

compare an impedance value of the helical coil with an impedance value of the power amplifier, and adjust a position of the driving loop for impedance matching between the helical coil and the power amplifier based on a result of the comparison, wherein the helical coil is further configured to generate the current by self-resonating at the output operation frequency based on the adjusted position of the driving loop.

2. The heating apparatus of claim 1, wherein the coil unit further includes one or more helical coils.

3. The heating apparatus of claim 2, wherein the at least one processor is further configured to:

in response to the impedance value of the helical coil being different from the impedance value of the power amplifier, output, to the driving loop, a control signal for moving the position of the driving loop for the impedance matching between the helical coil and the power amplifier.

4. The heating apparatus of claim 3, wherein the control signal is a command to move the position of the driving loop such that a center of the driving loop is identical to a center of the helical coil.

5. The heating apparatus of claim 1, further comprising:

a shielding plate, wherein the shielding plate is attached to surround an external area of the coil unit to prevent a magnetic field from being transferred externally.

6. The heating apparatus of claim 1, further comprising:

a waveguide attached onto one of walls of a housing of the heating apparatus, wherein the waveguide is configured to input a high frequency not less than a predetermined threshold frequency.

7. The heating apparatus of claim 6, wherein, in response to an input of the high frequency through the waveguide, the at least one processor is further configured to control the helical coil to use the high frequency until a variation in heating speed of an object is higher than or equal to a threshold value.

8. The heating apparatus of claim 7, wherein the at least one processor is further configured to control the signal generator to generate the operation frequency, in response to the variation in heating speed being higher than or equal to the threshold value.

9. The heating apparatus of claim 8, further comprising:

a structure configured to shield the operation frequency in a shielding plate attached onto an internal area of the housing except for a door of the housing, wherein the structure is further configured to:

shield the operation frequency during use of the high frequency, and operate as a shielding plate upon heating at the operation frequency, in response to the variation in heating speed being higher than or equal to the threshold value.

10. The heating apparatus of claim 1, further comprising:

a coupler arranged at before or after the power amplifier; and a container configured to be placed inside the housing, wherein, in response to the signal generator generating at least two operation frequencies, the coupler is configured to couple the at least two operation frequencies, wherein the container includes spaces having coils respectively installed to each space in the container, wherein the coils are configured to heat at least two objects, respectively, and wherein the amplified power is distributed to the respective coils of the spaces corresponding to power levels respectively required for the spaces.

11. A method performed by a heating apparatus, the method comprising:

generating, by a signal generator, an operation frequency;

amplifying, by a power amplifier, power of the operation frequency to a predetermined level, and outputting the operation frequency of the amplified power;

generating, by a helical coil included in a coil unit, a current at the output operation frequency, the coil unit further including a driving loop configured to operate in response to receiving the output operation frequency and the helical coil;

comparing, by at least one processor, an impedance value of the helical coil with an impedance value of the power amplifier; and adjusting, by the at least one processor, a position of the driving loop for impedance matching between the helical coil and the power amplifier based on a result of the comparison, wherein the current is generated by self-resonating of the helical coil at the output operation frequency based on the adjusted position of the driving loop.

12. The method of claim 11, wherein the coil unit further includes one or more helical coils.

13. The method of claim 12, further comprising:

in response to the impedance value of the helical coil being different from the impedance value of the power amplifier, outputting, to the driving loop, a control signal for moving the position of the driving loop for the impedance matching between the helical coil and the power amplifier.

14. The method of claim 13, wherein the control signal is a command to move the position of the driving loop such that a center of the driving loop is identical to a center of the helical coil.

15. The method of claim 11, wherein a shielding plate is attached to surround an external area of the coil unit to prevent a magnetic field from being transferred externally, and wherein a waveguide for inputting a high frequency not less than a predetermined threshold frequency is attached onto one of walls of a housing.

16. The method of claim 15, further comprising, in response to an input of the high frequency through the waveguide, controlling the helical coil, by the at least one processor, to use the high frequency until a variation in heating speed of an object is higher than or equal to a threshold value.

17. The method of claim 16, further comprising controlling, by the at least one processor, the signal generator to generate the operation frequency, in response to the variation in heating speed being higher than or equal to the threshold value.

18. The method of claim 17, wherein a structure shielding the operation frequency is provided in a shielding plate attached onto an internal area of the housing, except for a door of the housing, and wherein the method further comprises shielding, by the structure, the operation frequency during use of the high frequency, and operating the structure as a shielding plate upon heating at the operation frequency, in response to the variation in heating speed being higher than or equal to the threshold value.

19. The method of claim 11, wherein, in response to the signal generator generating at least two operation frequencies, a coupler arranged at before or after the power amplifier, wherein the coupler is configured to couple the at least two operation frequencies, wherein a container configured to be placed inside a housing includes spaces having coils respectively installed to each space in the container, wherein the coils are configured to heat at least two objects, respectively, and wherein the amplified power is distributed to the respective coils of the spaces corresponding to power levels respectively required for the spaces.

* * * * *